US006120387A

United States Patent [19]

Bobst

[11] Patent Number: 6,120,387

[45] Date of Patent: Sep. 19, 2000

[54] E-Z-UP GOLF BALL RETRIEVER SYSTEM

[76] Inventor: Glen L. Bobst, 2910-N St. Helena Hwy., St. Helena, Calif. 94574

[21] Appl. No.: 09/207,387

[22] Filed: Dec. 8, 1998

[51] Int. Cl.[7] ..... A63B 57/00

[52] U.S. Cl. ..... 473/286; 294/19.2

[58] Field of Search ..... 473/286; 294/19.2

[56] References Cited

U.S. PATENT DOCUMENTS

| | | | |
|---|---|---|---|
| 2,523,942 | 9/1950 | Ciambriello | 294/19.2 |
| 4,522,438 | 6/1985 | Logue | 294/19.2 |
| 4,610,373 | 9/1986 | Sherbondy | 294/19.2 |
| 4,678,108 | 7/1987 | Inman | 294/19.2 |
| 5,299,846 | 4/1994 | Rush | 294/19.2 |
| 5,437,488 | 8/1995 | Richmond | 294/19.2 |
| 5,921,598 | 7/1999 | Bredow | 294/19.2 |

*Primary Examiner*—Jeanette Chapman
*Assistant Examiner*—Stephen L. Blau

[57] ABSTRACT

A golf ball retriever system comprising a unitary retriever component which includes an enlarged first cylinder and a smaller second cylinder formed of a generally rigid elastomeric material molded integrally. The second cylinder has diametrically opposed axial slots which are adapted to be received over the reception area of the handle end of the putter. The first cylinder has an opened free end remote from the second cylinder and a diameter greater than that of a standard golf ball. A generally circular lateral aperture sized for the passage of a standard golf ball therethrough from interior of the first cylinder is located adjacent to the end of the first cylinder and in proximity to the second cylinder. A washer-like member fabricated of an elastomeric material is located adjacent to and interior of the open free end of the first cylinder and has an aperture with a diameter slightly less than the diameter of a standard golf ball but adapted to be enlarged upon the pressure by a golf ball pushed thereagainst for the entrapment of a standard golf ball within the first cylinder. The first cylinder is adapted to be inverted through the inversion of the putter whereby the center of the golf ball will be laterally disposed and adjacent to the center of the lateral aperture for the passage of a golf ball therethrough upon the tilting of the putter and first cylinder.

3 Claims, 3 Drawing Sheets

E-Z-UP GOLF BALL RETRIEVER SYSTEM

BACKGROUND OF THE INVENTION

1. Field of the Invention

The present invention relates to a golf ball retriever system and more particularly pertains to allowing the lifting of a golf ball without the golfer bending over.

2. Description of the Prior Art

The use of golfing aids of known designs and configurations is known in the prior art. More specifically, golfing aids of known designs and configurations heretofore devised and utilized for the purpose of conveniencing a golfer through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 2,760,807 to Watson discloses a Ball Retriever. U.S. Pat. No. 1,380,526 to Carpenter discloses a Retriever for Golf Balls. U.S. Pat. No. 5,460,366 to Pugh discloses a Golf Ball Retriever. U.S. Pat. No. 5,383,659 to Taylor discloses a Combination Golf Ball Pick-Up and Teeing Device. U.S. Pat. No. 5,132,622 to Valentino discloses a Method and Apparatus for Locating and Retrieving a Golf Ball Having a Metal Center. U.S. Pat. No. 5,004,250 to Taukamoto discloses a Golf Ball Retriever. U.S. Pat. No. 4,787,632 to Nigrelli discloses a Golf Club Accessory for Retrieving a Golf Ball. U.S. Pat. No. 4,687,204 to Lempio discloses a Golf Club Including Detachable Golf Ball Retriever. U.S. Pat. No. 3,698,720 to Gudmundsen discloses a Golf Ball Retriever. Lastly, U.S. Pat. No. 3,318,628 to White discloses a Combined Golf Club and Ball Retriever.

While these devices fulfill their respective, particular objectives and requirements, the aforementioned patents do not describe golf ball retriever system as described herein.

In this respect, the golf ball retriever system according to the present invention substantially departs from the conventional concepts and designs of the prior art, and in doing so provides an apparatus primarily developed for the purpose of allowing the lifting of a golf ball without the golfer bending over.

Therefore, it can be appreciated that there exists a continuing need for a new and improved golf ball retriever system which can be used for allowing the lifting of a golf ball without the golfer bending over. In this regard, the present invention substantially fulfills this need.

SUMMARY OF THE INVENTION

In view of the foregoing disadvantages inherent in the known types of Golfing aids of known designs and configurations now present in the prior art, the present invention provides an improved Golf ball retriever system. As such, the general purpose of the present invention, which will be described subsequently in greater detail, is to provide a new and improved golf ball retriever system and method which has all the advantages of the prior art and none of the disadvantages.

To attain this, the present invention essentially comprises a new and improved golf ball retriever system. The retriever system allows the lifting of a golf ball without the golfer having to bend over. The system comprises, in combination, a golf putter. The golf putter has a head end with a head thereat for striking a golf ball. The golf putter also has a handle end with a handle thereat for being grasped by a user. The head end has a cylindrical reception area. Also provided is a unitary retriever component. The retriever component includes an enlarged first cylinder and a smaller second cylinder. The cylinders are formed of a generally rigid elastomeric material. The first and second cylinders are molded integrally one with another. The second cylinder has diametrically opposed axial slots. The second cylinder is adapted to be received over the reception area of the handle end of the putter. The first cylinder has an opened free end remote from the second cylinder and has a diameter greater than that of a standard golf ball for the receipt thereof. The first cylinder has a generally circular lateral aperture located adjacent to the end thereof in proximity to the second cylinder and sized for the passage of a standard golf ball therethrough from interior of the first cylinder. A strap is provided with an associated bolt for positioning around the second cylinder and is adapted to reduce the diameter of the second cylinder for securement to the reception area of the handle end. Lastly provided is a washer-like member of an elastomeric material. The washer-like member is adjacent to the open free end of the first cylinder and interior thereof. The washer-like member has an aperture with a diameter slightly less than the diameter of a standard golf ball but adapted to be enlarged upon the application of pressure by a golf ball pushed thereagainst for the entrapment of a standard golf ball to within the first cylinder. The first cylinder is adapted to be inverted through the inversion of the putter whereby the center of the golf ball will be laterally disposed and adjacent to the center of the lateral aperture for the passage of a golf ball therethrough upon the tilting of the first golf club and first cylinder.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved golf ball retriever system which has all of the advantages of the prior art golfing aids of known designs and configurations and none of the disadvantages.

It is another object of the present invention to provide a new and improved golf ball retriever system which may be easily and efficiently manufactured and marketed for greater golfer convenience.

It is further object of the present invention to provide a new and improved golf ball retriever system which is of durable and reliable constructions to facilitate the playing of golf.

An even further object of the present invention is to provide a new and improved golf ball retriever system which is susceptible of a low cost of manufacture with regard to both materials and labor, and which accordingly is then susceptible of low prices of sale to the consuming public, thereby making such Golf ball retriever system economically available to the buying public.

Even still another object of the present invention is to provide a golf ball retriever system for allowing the lifting of a golf ball without the golfer bending over.

Lastly, it is an object of the present invention to provide a new and improved golf ball retriever system. The system comprises a unitary retriever component. The unitary retriever component includes an enlarged first cylinder and a smaller second cylinder. The cylinders are formed of a generally rigid elastomeric material and are molded integrally one with another. The second cylinder has diametrically opposed axial slots and is adapted to be received over the reception area of the handle end of the putter. The first cylinder has an opened free end remote from the second cylinder and a diameter greater than that of a standard golf ball for the receipt thereof. The first cylinder has a generally circular lateral aperture located adjacent to the end thereof in proximity to the second cylinder. The first cylinder is sized for the passage of a standard golf ball therethrough from interior of the first cylinder. Lastly provided is a washer-like member. The washer-like member is fabricated of an elastomeric material and is adjacent to the open free end of the first cylinder and interior thereof. The washer-like member has an aperture with a diameter slightly less than the diameter of a standard golf ball but adapted to be enlarged upon the application of pressure by a golf ball pushed thereagainst for the entrapment of a standard golf ball to within the first cylinder. The first cylinder is adapted to be inverted through the inversion of the putter whereby the center of the golf ball will be laterally disposed and adjacent to the center of the lateral aperture for the passage of a golf ball therethrough upon the tilting of the first golf club and first cylinder.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
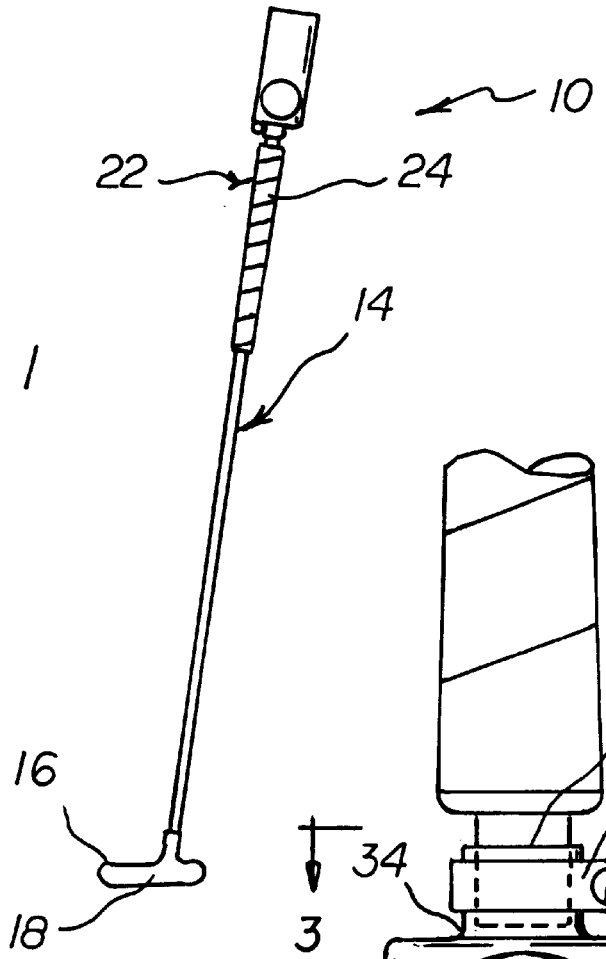
FIG. 1 is a perspective view of the preferred embodiment of the golf ball retriever system constructed in accordance with the principles of the present invention.

With reference now to the drawings, and in particular to FIG. 1 thereof, the preferred embodiment of the new and improved golf ball retriever system embodying the principles and concepts of the present invention and generally designated by the reference numeral 10 will be described.

The present invention, the golf ball retriever system 10, is comprised of a plurality of components. Such components in their broadest context include a golf putter, a retriever, a strap and a washer-like member. Such components are individually configured and correlated with respect to each other so as to attain the desired objective.

Figure 2:
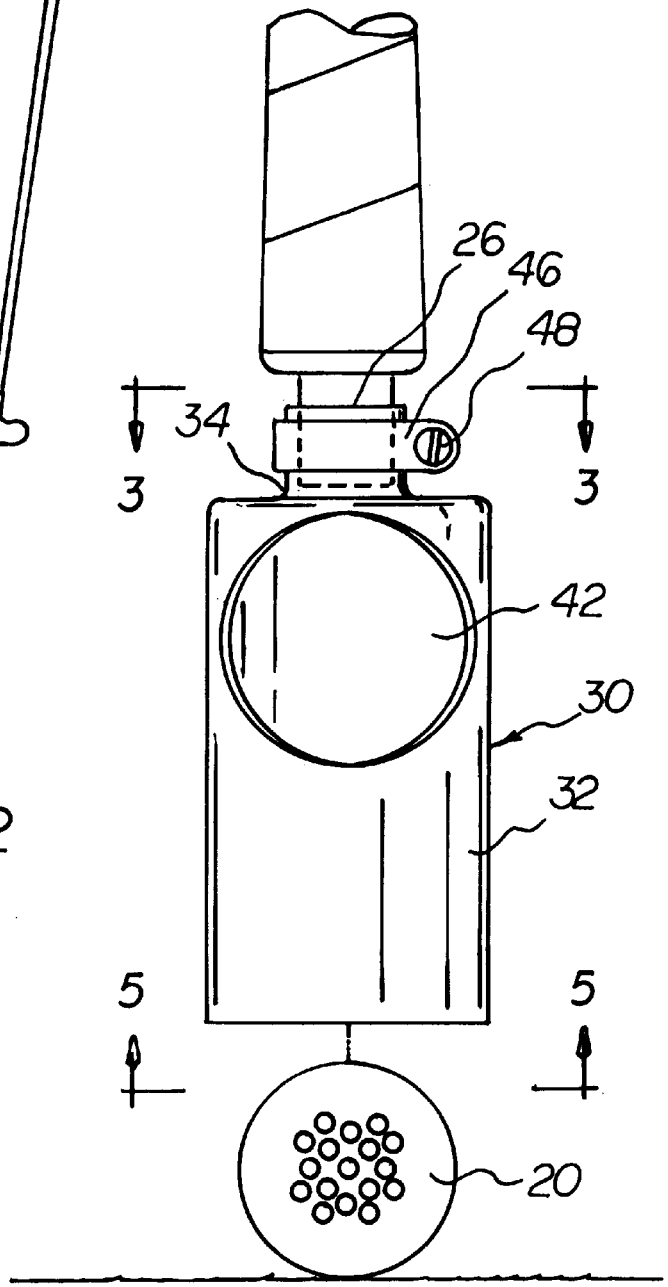
FIG. 2 is a side elevational view of the upper portion of the putter of FIG. 1 and the associated retriever component in an inverted orientation.
Figure 3:
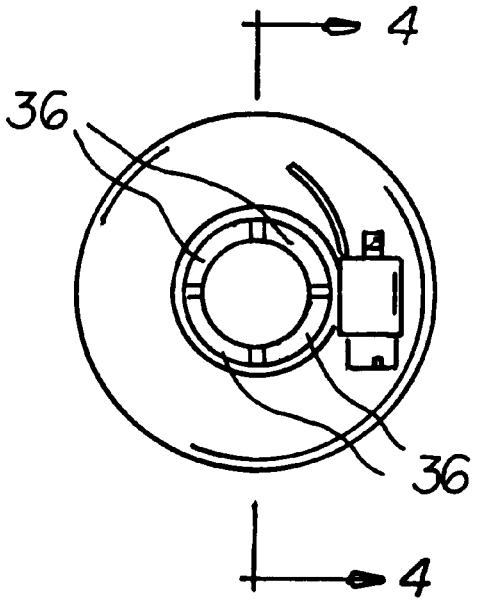
FIG. 3 is a end elevational view taken along line 3—3 of FIG. 2.
Figure 4:
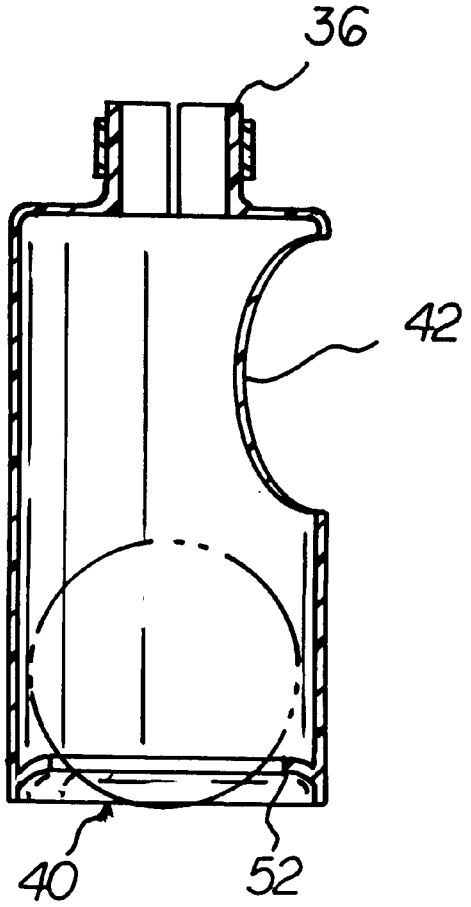
FIG. 4 is a cross-sectional view taken along line 4—4 of FIG. 3.
Figure 5:
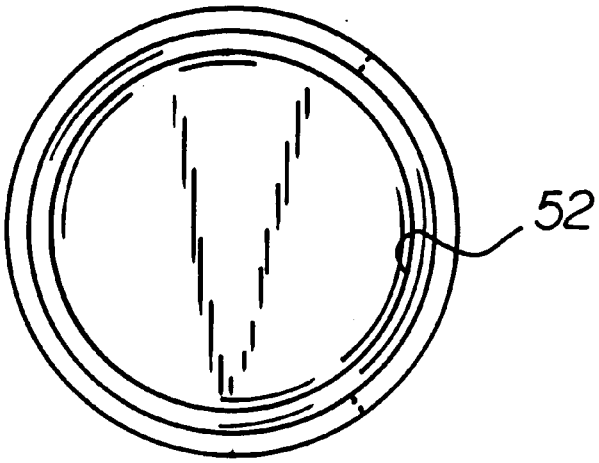
FIG. 5 is an end elevational view taken along line 5—5 of FIG. 2.
Figure 6:
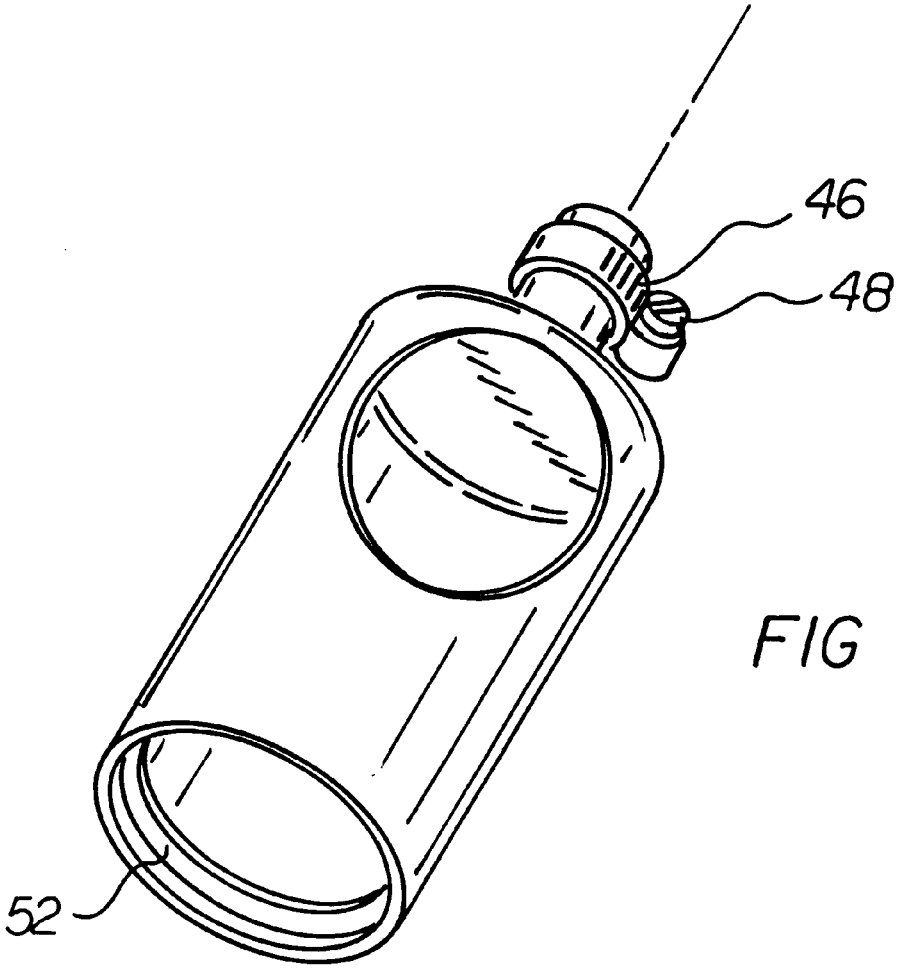
FIG. 6 is a perspective illustration similar to FIGS. 2 and 4 but without a golf ball or putter.

The present invention as described herein is a new and improved golf ball retriever system. The system 10 allows the lifting of a golf ball without the golfer bending over. The system comprises, in combination, a golf putter 14. The golf putter is generally conventional and has a head end 16 with a head 18 thereat for striking a golf ball 20. The putter also has a handle end 22 with a handle 24 thereat for being grasped by a user. The head end has a cylindrical reception area 26 for purposes as will be later understood. Note FIGS. 1 and 2.

The system also comprises a unitary retriever component 30. The retriever component includes an enlarged first cylinder 32 and a smaller second cylinder 34. The cylinders are formed of a generally rigid elastomeric material. The first and second cylinders are molded integrally one with another with a common central axis.

The second cylinder has diametrically opposed axial slots 36. Such cylinder is adapted to be removably received over the reception area of the handle end of the putter during operation and use.

The first cylinder has an opened free end 40 remote from the second cylinder. It is formed to have an interior diameter greater than that of a standard golf ball 20 for the receipt thereof. The first cylinder is formed with a thin wall to allow insertion of the cylinder into a golf hole for picking up a golf ball without bending over. A ball, however, can be picked up from any supporting surface, green, fairway or carpet.

The first cylinder also has a generally circular lateral aperture 42 located adjacent to the end thereof in proximity to the second cylinder. It is sized for the passage of a standard golf ball therethrough from interior of the first cylinder.

Additionally provided is a strap 46. The strap has an associated bolt 48 rotatably secured in apertures associated with the ends of the strap. At least one such aperture is threaded. The strap is positioned around the second cylinder. The rotation of the bolt is adapted to reduce the diameter of the second cylinder for securement to the reception area of the head end.

Lastly provided in the system is a washer-like member 52. The washer-like member is fabricated of an elastomeric material and is adjacent to the open free end of the first cylinder and interior thereof. The washer-like member has an aperture with an interior diameter slightly less than the diameter of a standard golf ball but is adapted to be enlarged upon the application of pressure by a golf ball pushed thereagainst. This is for the entrapment of a standard golf ball to within the first cylinder. After a golf ball is moved to interior of the first cylinder, such first cylinder is adapted to be inverted through the inversion of the putter. This causes the center of the golf ball to be moved to a location laterally disposed from, and adjacent to, the center of the lateral aperture for the passage of a golf ball therethrough. Such passage occurs upon the tilting of the first golf club and first cylinder.

The golf ball retriever of the present invention is a system to enable golfers to pick-up golf balls without having to bend over. The system thereby enables more people to play golf; specifically, those players with injuries which might prevent them from bending over.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved golf ball retriever system for allowing the lifting of a golf ball without the golfer bending over comprising, in combination:

a golf putter having a head end with a head thereat for striking a golf ball and having a handle end with a handle thereat for being grasped by a user, the handle end having a cylindrical reception area;

a unitary retriever component including an enlarged first cylinder and a smaller second cylinder formed of a generally rigid elastomeric material, the first and second cylinders being molded integrally one with another;

the second cylinder having diametrically opposed axial slots and adapted to be received over the reception area of the handle end of the putter;

the first cylinder having an opened free end remote from the second cylinder and having a diameter greater than that of a standard golf ball for the receipt thereof, the first cylinder having a generally circular lateral aperture located adjacent to the end thereof in proximity to the second cylinder and sized for the passage of a standard golf ball therethrough from interior of the first cylinder;

a strap with an associated bolt positioned around the second cylinder adapted to reduce the diameter of the second cylinder for securement to the reception area of the handle end; and a washer-like member of an elastomeric material adjacent to the open free end of the first cylinder and interior thereof, the washer-like member having an aperture with a diameter slightly less than the diameter of a standard golf ball but adapted to be enlarged upon the application of pressure by a golf ball pushed thereagainst for the entrapment of a standard golf ball to within the first cylinder, the first cylinder adapted to be inverted through the inversion of the putter whereby the center of the golf ball will be laterally disposed and adjacent to the center of the lateral aperture for the passage of a golf ball therethrough upon the tilting of the putter and first cylinder.

2. A golf ball retriever system for attaching to a handle end of a putter comprising:

a unitary retriever component including an enlarged first cylinder and a smaller second cylinder formed of a generally rigid elastomeric material, the first and second cylinders being molded integrally one with another;

the second cylinder having diametrically opposed axial slots and adapted to be received over the handle end of the putter;

the first cylinder having an opened free end remote from the second cylinder and having a diameter greater than that of a standard golf ball for the receipt thereof, the first cylinder having a generally circular lateral aperture located adjacent to the end thereof in proximity to the second cylinder and sized for the passage of a standard golf ball therethrough from interior of the first cylinder; and a washer-like member of an elastomeric material adjacent to the open free end of the first cylinder and interior thereof, the washer-like member having an aperture with a diameter slightly less than the diameter of a standard golf ball but adapted to be enlarged upon the application of pressure by a golf ball pushed thereagainst for the entrapment of a standard golf ball to within the first cylinder, the first cylinder adapted to be inverted through the inversion of a putter whereby the center of the golf ball will be laterally disposed and adjacent to the center of the lateral aperture for the passage of a golf ball therethrough upon the tilting of the putter and first cylinder.

3. The system as set forth in claim 2 and further including a strap with an associated bolt positioned around the second cylinder adapted to reduce the diameter of the second cylinder for securement to the reception area of the handle end.

* * * * *